US005108630A

United States Patent [19]

Black et al.

[11] Patent Number: 5,108,630

[45] Date of Patent: Apr. 28, 1992

[54] PROCESS FOR OVERBASING SULFONATES COMPRISING TWO SEPARATE ADDITIONS OF CALCIUM OXIDE

[75] Inventors: Elzie D. Black; Leonard A. Matthews; William J. Powers, III, all of Port Arthur; Robert W. Erickson, Jr., Port Neches, all of Tex.

[73] Assignee: Texaco Inc., White Plains, N.Y.

[21] Appl. No.: 597,951

[22] Filed: Oct. 10, 1990

[51] Int. Cl.[5] ..... C10M 135/10

[52] U.S. Cl. ..... 252/18; 252/33

[58] Field of Search ..... 252/18, 33

[56] References Cited

U.S. PATENT DOCUMENTS

| | | | |
|---|---|---|---|
| 3,896,037 | 7/1975 | Dickey | 252/18 |
| 4,086,170 | 4/1978 | DeClippeleir et al. | 252/18 |
| 4,427,559 | 1/1984 | Whittle | 252/33.2 |
| 4,604,219 | 8/1986 | Whittle | 252/33 |
| 4,780,224 | 10/1988 | Jao | 252/18 |
| 4,810,396 | 3/1989 | Jao et al. | 252/33 |
| 4,880,550 | 11/1989 | Hunt | 252/33 |
| 4,929,373 | 5/1990 | Powers, III et al. | 252/33 |
| 4,954,272 | 9/1990 | Jao et al. | 252/18 |
| 4,995,993 | 2/1991 | Papke et al . | 252/25 |
| 4,997,584 | 3/1991 | Jao et al. | 252/33 |

*Primary Examiner*—Prince Willis, Jr.
*Assistant Examiner*—Jerry D. Johnson
*Attorney, Agent, or Firm*—Jack H. Park; Kenneth R. Priem; Richard A. Morgan

[57] ABSTRACT

In an overbased sulfonate process calcium hydroxide is formed in situ. The entire water charge and 30 to 50% of the calcium oxide is added. The temperature exotherm is observed. When the temperature ceases to rise, the remaining calcium hydroxide is added with temperature adjustment and carbonation is begun.

2 Claims, No Drawings

PROCESS FOR OVERBASING SULFONATES COMPRISING TWO SEPARATE ADDITIONS OF CALCIUM OXIDE

BACKGROUND OF THE INVENTION

1. Field of the Invention

The invention is an improved process for preparing overbased sulfonates which are used as detergent and reserve alkalinity lubricating oil additives.

2. Description of Other Related Methods in the Field

In the course of operation, internal combustion engines convert lubricating oil to acidic degradation products. Those acidic degradation products attack and corrode engine parts and catalyze the formation of sludge, thereby reducing lubricity and accelerating wear of moving parts in contact with the lubricating oil.

It is desirable to add substances to the lubricating oil which neutralize acids as they are formed in the engine before they reach concentrations sufficient to cause corrosion or to catalyze the sludge reaction. Adding alkalinity agents to the detergent in motor oil for this purpose is known as overbasing. Colloidal carbonates of alkaline earth metals have been found to be well suited for this purpose. These colloidal carbonate dispersions are stabilized by oil soluble surface active agents such as sulfonates of the alkaline earth metals in which the sulfonic acid portion of the molecule has a molecular weight of preferably 450 to 600. The sulfonates are made by sulfonation of lubricating oil fractions from petroleum and by sulfonation of alkyl benzenes having the required molecular weight. Benzene alkylates with straight chain alkyl groups are especially effective.

U.S. Pat. No. 4,780,224 to Tze-Chi Jao teaches a method of preparing overbased calcium sulfonates. In the method, calcium hydroxide is formed in situ by first adding 25% of the total water and then adding the remainder of the water to calcium oxide during hydration and carbonation.

U.S. Pat. No. 4,810,396 to Tze-Chi Jao et al. teaches a process for preparing overbased calcium sulfonates. In the method the entire amount of calcium oxide, calcium hydroxide and water are charged in a specified ratio before carbonation.

U.S. Pat. No. 4,604,219 to J. R. Whittle teaches a method of preparing overbased calcium sulfonates. In the method calcium hydroxide is formed in situ by the continuous and uniform addition of water to calcium oxide over the entire hydration and carbonation time rather than incrementally. Water rate and amount were found to be critical.

SUMMARY OF THE INVENTION

The invention is an improved process for preparing an overbased sulfonate. Sulfonates are overbased by diluting a neutral sulfonate with a light hydrocarbon solvent and a lower alkanol. Next, the entire change of water to be used and 30% to 50% of the calcium oxide is added. Calcium oxide is slaked to calcium hydroxide in an exothermic reaction. The exothermic temperature rise of the reaction mixture is observed. Slaking of the initial calcium oxide charge is complete when the temperature ceases to rise and levels off. The remaining calcium oxide is then added with mixing.

The temperature of the admixture is adjusted to 100° F. to 170° F. at a pressure of 0 psig to 50 psig. The admixture is then carbonated for 1 to 4 hours, preferably 1 to 3 hours. When carbonation is completed, a diluent oil is added and solids are removed. Solvent is stripped, leaving an overbased sulfonate as a liquid product.

DESCRIPTION OF THE PREFERRED EMBODIMENTS

A process for overbasing sulfonates has been discovered. The entire amount of water to be used is added to a dilute slurry of calcium oxide in a mixture of neutral sulfonate, hydrocarbon solvent and lower alkanol. The remaining calcium oxide is added to the reaction mass while the temperature is maintained in the desired range. The reaction mass is then carbonated with carbon dioxide.

The operating parameters of the process are tabulated in Table I.

TABLE I

| Variable | Operable Range | Preferred Range |
|---|---|---|
| 1. Reaction Temperature, °F. | 100–170° | 130–150° |
| 2. Pressure, psig | 0–50 | 0–20 |
| 3. Mole ratio $H_2O/CaO$ | 0.1–1.2 | 0.4–0.8 |
| 4. Mole ratio $CO_2CaO$ | 0.6–0.9 | 0.8 |
| 5. Hydrocarbon Solvent, wt % | 37–50 | 40–50 |
| 6. Alcohol, wt % | 4.7–7.2 | 4.8–5.8 |
| 7. Carbonation and Hydration Time, min | 60–240 | 60–180 |

Examples of useful and preferred reactants which may be employed in the practice of the invention are listed in Table II.

TABLE II

| | | |
|---|---|---|
| 1. Calcium Oxide | | One with a total slaking time of 4.5–35 minutes and a temperature rise of 6° C. max in the first 30 sec. as measured by ASTM C-110-76a. |
| 2. Sulfonate | Neutralized "sulfonic acid" derived from a natural feedstock. Neutralized "sulfonic acid" derived from a synthetic feedstock. Blends of Neutralized sulfonic acids from natural and synthetic feedstocks. | Blends of neutralized sulfonic acids from natural and synthetic feedstocks. |
| 3. Diluent Oil | 100–500 SUS (@ 40° C.) pale stock. 100–500 SUS solvent neutral oil. | 100 SUS pale stock hydro-finished |
| 4. Hydrocarbon Solvent | Straight run gasoline, dehexanized raffinate gasoline, normal or mixed hexanes, normal or mixed heptanes, benzene or toluene. | Crude heptane |
| 5. Lower Alcohols | $C_1$—$C_5$ normal or branced chain alcohols. | Methanol |

In carrying out the inventive process the process technician handles only one solid reagent, calcium oxide, to produce on overbased sulfonate that contains only amorphous calcium carbonate with no crystalline product. This is accomplished without the exercise of close control of reagent addition rate.

The process taught in U.S. Pat. No. 4,604,219 (Comparative Examples 1 and 2) requires close control of the rate of water addition to the reaction mass. Failure to control the water rate within the tolerance results in formation of a crude overbased sulfonate that is difficult to filter and/or exhibits an intractably high viscosity. All products prepared using this process contain at least a minor amount of crystalline material in the amorphous calcium carbonate. Amorphous calcium carbonate is characterized by a broad, symmetrical band in the infrared spectrum at frequency of about 865 $cm^{-1}$ while crystalline calcium carbonate has an absorbance at 875 $cm^{-1}$ that is generally sharp and asymmetric. U.S. Pat. No. 4,780,224 teaches that the presence of crystalline dispersed carbonate in overbased sulfonates is disadvantageous in lubricating oil formulations.

The process taught in U.S. Pat. No. 4,780,224 (Comparative Example 3) circumvents the problem of crystalline material in the amorphous calcium carbonate. The process requires close control of the rate of water addition to the reaction mass. As demonstrated in Comparative Example 3 (Example 1 of that patent), production of an overbased sulfonate exhibiting a TBN exceeding 400 and having all of the dispersed calcium carbonate in the amorphous phase has been achieved by the application of extraordinary process control.

U.S. Pat. No. 4,810,396 (Comparative Example 4) teaches a process wherein a portion of the overbasing material is introduced as calcium hydroxide, rather than calcium oxide. This frees the process technician from the requirement to closely monitor and control water addition rate. This technique, however, requires the handling of two difference solid reagents. This requires a more mechanically complex apparatus be used. For example, two solids silos, with associated conveying and measuring hardware, rather than one, are required, which raises plant investment and maintenance cost.

EXAMPLE 1

Comparative

An overbased sulfonate was made according to the procedure taught in U.S. Pat. No. 4,604,219.

A jacketed eighty gallon stainless reactor equipped with a mechanical stirrer was charged with a blend of neutral calcium sulfonate (44 wt % active), 74.3 lbs; technical grade mixed heptanes, 192.4 lbs; calcium oxide, 37.0 lbs; and methanol, 18.2 lbs. Stirring was initiated and the temperature of the reaction mass was adjusted to 105° F. At this point, water addition was initiated through a dip tube and introduction of gas carbon dioxide was started through a sparger. The reaction exotherm caused reaction mass temperature to increase and a cooling medium was circulated through the reactor jacket to keep the reaction temperature in the range of 140° to 150° F. Rate of water and carbon dioxide addition were controlled so that the desired charges of 9.4 lbs. of water and 22.7 lbs. of carbon dioxide were completed in 180 minutes. After the reaction was completed, the system was cooled to 120° F. and a refined lubricant range petroleum distillate, 35.2 lbs, was added. An aliquot of the reaction mass, which had a solids content of 7 volume %, was removed and filtered. Filtration rate was observed to be rapid, producing a clear filtrate. After removal of solvent by vacuum stripping, the following test results were observed:

| | |
|---|---|
| TBN (ASTM D-2896) | 387 |
| Ca Sulfonate, wt % | 17.7 |
| Appearance | Dark clear fluid syrup |
| Infrared Spectrum | Carbonate absorbance at 865 $cm^{1}$, |

-continued

| | |
|---|---|
| | sharp shoulder at 877 $cm^{-1}$ |

EXAMPLE 2

Comparative

An overbased calcium sulfonate was made according to Example 1 of U.S. Pat. No. 4,604,219.

Calcium sulfonate (291 g containing 42.4% active material) was diluted with a light hydrocarbon solvent (781 g) and methanol (100 g). To the diluted mixture was added calcium oxide (150 g). The mixture was stirred and heated to 140° F. and then gaseous carbon dioxide (92 g) and water (38 g) were introduced into the mixture over a three hour period. A 100–500 SUS@40° C. diluent oil (132 g) was then added. The crude reaction mixture contained 10 volume percent solids. The mixture was then filtered through diatomaceous earth and a filtration rate of 12.3 gal of 400 TBN product/hr-$ft^2$ was obtained. The filtrate was then heated to 250° F. to remove the solvent. The solvent-free filtrate (663 g) was bright and clear and had a TBN of 416, a calcium sulfonate content of 18.3, and a Kin Vis@100° C. of 137.25 cSt. The sulfonate utilization was 98.2% and the lime utilization was 91.9%.

EXAMPLE 3

Comparative

An overbased calcium sulfonate was made according to Example 1 of U.S. Pat. No. 4,780,224.

A blend containing 32 parts by weight of a normal sulfonate, 91 parts heptane, 8 parts methanol and 18 parts calcium oxide was brought to reflux at 65° C. in a 500 ml reaction flask. One part of water was added. The mixture was refluxed for 10 minutes. $CO_2$ was then introduced into the reaction mixture at a rate of 40 ml/min, with water addition at a rate of 1.65 ml/hr. The total amount of water used was 4 parts. The addition of water was terminated 20 minutes before the completion of $CO_2$ addition. The $CO_2$ addition was stopped after 130 minutes.

The filtered and solvent-stripped final product had a TBN value of 440 to 470. Its infrared spectrum showed a symmetric band with a frequency of 865 cm (−1) indicating amorphous calcium carbonate and no trace of crystalline carbonate (875 cm(−1)). The filtration rate of the crude product was about 0.3 ml/sec through a Whatman No. 1 filter paper and was about the same as the rate for samples from the regular water-addition process.

EXAMPLE 4

Comparative

An overbased calcium sulfonate was made according to the procedure of U.S. Pat. No. 4,810,396.

A blend containing neutral calcium sulfonate, crude heptane, methanol, calcium oxide and calcium hydroxide was heated to 40° C. in a 10-gallon reactor. Water was added. The reaction mixture was then brought to reflux at 60° C. $CO_2$ was introduced into the reaction mixture at a rate of 5.33 liter/min as soon as the reaction mixture reached the reflux temperature. The $CO_2$ treatment was stopped after 165 minutes. Then pale oil was added and stirred for an additional 10 minutes.

The results were as follows:

| | |
|---|---|
| Initial Charge, parts by wt. | |
| Calcium Oxide | 0.00 |
| Crude Heptane | 0.00 |
| Water | 0.00 |
| Calcium Chloride | 0.00 |
| Second Charge, parts by wt. | |
| Calcium Sulfonate | 17.71 |
| Crude Heptane | 49.06 |
| Methanol | 6.45 |
| Calcium Hydroxide | 5.42 |
| Calcium Oxide | 6.15 |
| Water | 0.60 |
| Calcium Chloride | 0.06 |
| Carbon Dioxide, parts by wt. | 6.15 |
| Diluent Oil, parts by wt. | 8.40 |
| Results | |
| Solids in Crude Product, Vol % | 20 |
| Filtered/Stripped Product Tests | |
| TBN (ASTM D-2896) | 404 |
| Ca Sulfonate, wt % | 18.3 |
| Appearance | dark, clear, fluid syrup |
| Infrared Spectrum | No shoulder at 875 $cm^{-1}$, broad peak at 866 $cm^{-1}$. |

EXAMPLES 5, 6, & 7

Overbased sulfonates were made according to the process. Calcium oxide, crude heptane and calcium chloride were added to a 10 gallon stainless steel reactor. The mixture was warmed to 40° C. with stirring. At 40° C., an amount of water was added and stirring was continued for 1 hour.

Neutral calcium sulfonate, calcium oxide and methanol were added to the reaction mixture. The mixture was heated to 60° C. and carbon dioxide introduced at a rate of 5.33 liter/min for 3 hours. Carbon dioxide addition rate was regulated to maintain the temperature between 60° C. and 65.6° C. At the end of the carbonation, 100 P pale oil was added. The crude reaction mixture was filtered and the solvent was removed under vacuum at 120° C. to recover the finished product.

The products were sampled. Test results were as follows:

TABLE I

| Example Number | 5 | 6 | 7 |
|---|---|---|---|
| Initial Charge, parts by wt. | | | |
| Calcium Oxide | 3.08 | 5.01 | 4.10 |

TABLE I-continued

| Example Number | 5 | 6 | 7 |
|---|---|---|---|
| Crude Heptane | 49.06 | 49.06 | 49.06 |
| Water | 1.91 | 1.91 | 1.91 |
| Calcium Chloride | 0.06 | 0.06 | 0.06 |
| Second Charge, parts by wt. | | | |
| Calcium Sulfonate | 17.71 | 17.71 | 17.71 |
| Methanol | 6.45 | 6.45 | 6.45 |
| Calcium Oxide | 7.18 | 5.10 | 6.15 |
| Carbon Dioxide, parts by wt. | 6.15 | 6.15 | 6.15 |
| Diluent Oil, parts by wt. | 8.40 | 8.40 | 8.40 |
| Results | | | |
| Solids in Crude Product, Vol % | 20 | 20 | 20 |
| Filtered/Stripped Product Tests | | | |
| TBN (ASTM D-2896) | 390 | 381 | 381 |
| Ca Sulfonate, wt % | 19.2 | 19.0 | 19.4 |
| Appearance | All dark, clear, fluid syrups | | |
| Infared Spectrum | All - No absorption characteristic of crystalline $CaCO_3$ (875 $cm^{-1}$ shoulder absent) | | |

TBN(Total Base Number) = $\frac{\text{milligram KOH}}{\text{gram sample}}$

KOH — Potassium Hydroxide

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A process for preparing an overbased sulfonate wherein calcium oxide is the sole alkalinity agent, the steps comprising:
   (a) diluting a neutral sulfonate with a light hydrocarbon solvent and a lower alkanol;
   (b) admixing 30% to 50% of the total calcium oxide and 100% of the total liquid water with the calcium sulfonate and observing an exothermic temperature rise;
   (c) when the temperature rise ceases, admixing the remaining calcium oxide;
   (d) heating the resulting mixture to about 100° F. to 170° F. at a pressure of about 0 to 50 psig;
   (e) introducing carbon dioxide into the mixture over a time of 60 to 240 minutes;
   (f) adding a diluent oil;
   (g) separating solids from the liquid; and
   (h) stripping the solvent from the resulting liquid product.

2. The process of claim 1 wherein step(b), about 40% of the total calcium oxide is admixed.

* * * * *